United States Patent [19]

Barman

[11] Patent Number: 4,571,915

[45] Date of Patent: Feb. 25, 1986

[54] FIREPROOF AND SOUNDPROOF DOOR

[75] Inventor: Mohan Barman, Willowdale, Canada

[73] Assignee: Produits d'Acier Anjou, Inc., Ville d'Ajou, Canada

[21] Appl. No.: 572,248

[22] Filed: Jan. 20, 1984

[51] Int. Cl.[3] ..... E04C 2/54

[52] U.S. Cl. ..... 52/785; 52/793; 52/809; 52/403

[58] Field of Search ..... 52/785, 793, 802, 809, 52/455, 456, 398, 402, 403; 49/DIG. 2, DIG. 3

[56] References Cited

U.S. PATENT DOCUMENTS

| | | | |
|---|---|---|---|
| 2,117,397 | 5/1938 | Bonsall | 52/809 |
| 3,333,382 | 8/1967 | De Ridder | 52/403 X |
| 3,353,318 | 11/1967 | Bacher | 52/403 |

*Primary Examiner*—J. Karl Bell

*Assistant Examiner*—Creighton Smith

[57] ABSTRACT

In a door or the like having spaced-apart planar side panel members and baffle means intermediate the members, the baffle means comprises an elongated planar member secured to and extending from the respective side panel members such that the planar members lie in spaced parallel relation one to another and extend toward one another in overlapping arrangement and the free ends of the planar members terminate in spaced relation with the panel members. The improvement comprises the filler means intermediate the free ends and panel members whereby to provide a partially sealed cavity between the planar members. Also disclosed is a method of preventing or limiting deformation of a door panel when located adjacent fire in turn preventing or limiting deformation of the door edges affecting securement of the door.

7 Claims, 2 Drawing Figures

FIREPROOF AND SOUNDPROOF DOOR

BACKGROUND OF THE INVENTION

1. Field of the Invention

The present invention relates to an improved soundproof fire door. The invention also relates to a method of preventing or limiting the deformation of an outer door panel in case of a fire and thus preventing or limiting deformation of the door edges within its associated frame, which might otherwise cause the door to open during a fire.

2. Description of the Prior Art

Soundproof fire doors or the like having spaced-apart metal planar side panel members filled with a sound and thermal insulation material and provided with adjacent overlapping baffles extending longitudinally from the respective side panel members are known.

However, the metal-to-metal contact of the baffles allows heat conduction from one side panel to the other and allows sound transmission through the door.

SUMMARY OF THE INVENTION

In a construction in accordance with the present invention, the spacer means are provided in a spaced-apart relationship along the free edge of one of the planar members and a second plurality of spaced elongated members adjacent the free end of the other of the planar members, the first and second plurality of members being arranged in staggered relation whereby a plurality of staggered passages is thereby provided between the baffles.

In a further preferred embodiment according to the present invention, the filler material is silicone rubber.

In a still further preferred embodiment according to the present invention, the space between the planar side panel members is filled with fiberglass insulation material and abuts the outer sides of the baffle means. Furthermore, the inner surface of the panels in contact with the fiberglass are coated with Aquaplas DL-10 (trade mark of H. L. Blachford) material.

In one aspect of the present invention, there is provided in a door or the like having spaced-apart planar side panel members, baffle means intermediate the members. The baffle means comprise an elongated planar member secured to and extending from the respective side panel members such that the planar members lie in spaced parallel relation one to another and extend toward one another in overlapping arrangement and the free edges of the planar members terminate in spaced relation with the panel members. The improvement comprises filler means provided adjacent the free edges of the panel members whereby to prevent direct contact therebetween and to provide an interrupted sound passage.

In a further aspect of the present invention, there is provided an improvement as defined immediately above, wherein the elongated planar members of the baffle means extend obliquely, i.e., not perpendicularly, from the plane of the respective side panel members. This latter arrangement particularly applies in the case of a fire door, as will be appreciated from the description hereinafter.

In a still further aspect of the present invention, there is provided a method of preventing or limiting the deformation of an outer panel of a door when located adjacent fire and thus preventing or limiting deformation of the door edge within its associated door frame, comprising the step of providing at least one pair of members located in spaced parallel relation one to another intermediate the outer panels of the door and arranged to extend obliquely from the respective door panels; securing one of the members to one of the panels; and securing the other of the pair of members to the other of the panels; whereby when one of the panels becomes deformed or bowed from the fire, it is restrained in its bowing movement by the pair of members acting against each other in cooperation with the door panel remote from the fire.

BRIEF DESCRIPTION OF THE DRAWINGS

Having thus generally described the nature of the invention, reference will now be made to the accompanying drawings, showing by way of illustration, a preferred embodiment thereof, and in which.

DESCRIPTION OF THE PREFERRED EMBODIMENTS

Referring now in detail to the drawings, there is shown in part a door 100 having spaced-apart planar side panel members 10 and 20 and a baffle means 30 intermediate the same. Although only one baffle means 30 is shown, it is to be understood that a number of such may be utilized in a door 100 and arranged in similar manner between members 10 and 20. It is envisaged that baffle means 30 may extend diagonally of a door as well as horizontally or vertically thereof.

Figure 1:
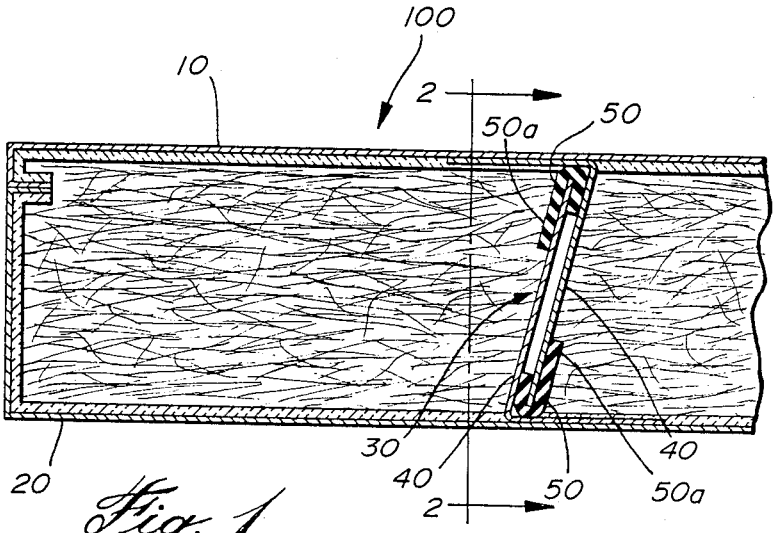
FIG. 1 is a top part cross-sectional view through a door or the like and showing the improvement according to the present invention, namely, a door or the like having an improved baffle arrangement therein.

As again seen from FIG. 1, members 10 and 20 are bent and thereafter joined to provide a peripheral edge for the door 100. Baffle means 30 comprises a first elongated planar member 40 secured to and extending obliquely from member 10 and a second elongated planar member 40 secured to and extending obliquely from member 20. Members 40, it will be noted, terminate in spaced relation to members 10 and 20 and are parallel spaced apart. Filler means 50 comprises sheet rubber material extending intermediate the free ends of members 40 and respective members 10 and 20. Filler means 50 also extends between members 40 and outwardly thereof to facilitate securing of the same in place on member 40 with the aid of suitable bonding material. Filler means 50 extend between members 40 away from the respective free ends thereof a suitable distance which in the case of the preferred embodiment disclosed measures ¼ inch. Likewise filler means 50 may extend to any desired point away from said free ends on the further side, including to that shown in FIG. 1 and being approximately twice that of the lip extension between members 40.

Figure 2:
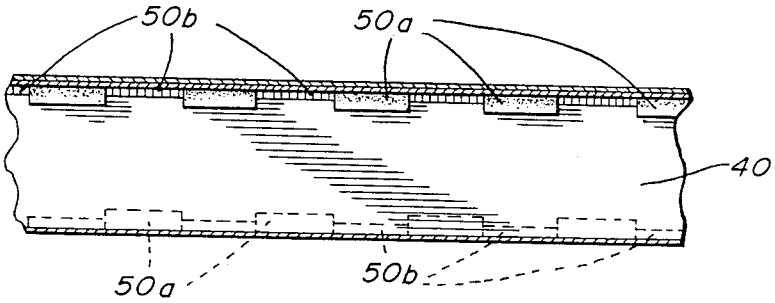
FIG. 2 is a part elevational view of the baffle arrangement seen in FIG. 1 as viewed in the direction of arrow A.

Referring to FIG. 2, it will be seen that filler means 50 comprises a first plurality of spaced elongated members **50*a*, shown in full line, situated adjacent said free end of near member 40, and a second plurality of spaced elongated members 50*a*, shown in dotted line, situated adjacent said free end of far member 40, thereby providing a series of staggered apertures 50*b* in baffle 30. Such arrangement provides a partially enclosed cavity between members 40. Filler means 50**, in the case of the embodiment disclosed, comprises silicone rubber of 60 durometer hardness and is fabricated from 1/16 inch thick sheet material. As may be realized, other materials having suitable characteristics may be substituted therefor.

As indicated above and shown in FIG. 1, the inner faces of members 10 and 20 may include a coating of Aquaplas DL-10. Such coating may be applied at any suitable rate including that of the embodiment disclosed comprising two pounds per square foot. Also, as seen in FIG. 1, the cavity intermediate members 10 and 20 may be filled with fiberglass insulation, including that having a density of 2.5 pounds per cubic foot.

As indicated above, the arrangement according to the preferred embodiment shown in FIG. 1, is particularly applicable in the case of a fire door since such helps to reduce deformation of the outer panels of the door and accordingly ensure a relatively tight fitting of the door within the door frame when fire is present adjacent one of the outer panels of the door.

In order to better understand this feature, reference is made to FIG. 1. When fire heat is, for example, present adjacent the panel designated 10, such will tend to expand and bow outwardly of the door. Member 40 attached thereto will thus move in a similar direction and will apply a resulting force in a direction normal to the plane of the door and, in doing so, pull member 40 attached to the relatively cool further panel 20, possibly causing it to bow to a degree in similar direction to that of panel 10. Thus, it will be appreciated that baffle means 30 under such circumstances acts to minimize the bowing of panel 10 which in turn minimizes any resulting bowing or deformation of the edges of door 100, accordingly ensuring that the door edges remain relatively tight in the door frame and the associated locking or latch means remains substantially in place to thereby positively secure the door and prevent its springing open during the presence of fire.

From the foregoing, it will be seen that there is provided an improved door or the like of the fireproof type, resulting from an improved soundproofing baffle arrangement therefor. As mentioned, filler means having different dimensions and composition to that indicated may be utilized in the baffle arrangement(s), accordingly satisfying various soundproofing requirements while meeting fireproofing conditions.

I claim:

1. In a door or the like having spaced-apart planar side panel members and baffle means intermediate the members, the baffle means comprising at least a pair of elongated planar members with one of each pair secured to and extending from a respective side panel member such that the planar members of each pair lie in spaced parallel relation one to another and extend toward the other side panel in overlapping arrangement and the free edges of the planar members terminate in spaced relation with the panel members, the improvement comprising spacer means adjacent said free edges and between panel members said spacer means comprises a first plurality of spaced elongated members adjacent the free edges of one of said planar members and a second plurality of spaced elongated members adjacent the free end of the other of said planar members, said first and second pluralities of members being arranged in staggered relation whereby to prevent direct contact therebetween and to provide an interrupted staggered sound passage between said planar members.

2. The improvement as defined in claim 1, wherein said elongated planar member extends obliquely from said side panel member.

3. The improvement as defined in claim 1, wherein said spacer means comprises silicone rubber material.

4. The improvement as defined in claim 1, wherein said spacer means comprises silicone rubber material in the form of sheet material arranged to lie over said free edges and extend lip-wise partially between said planar members and seal therewith.

5. The improvement as defined in claim 1, wherein said spacer means comprises silicone rubber material of 60 durometer hardness in the form of 1/16 inch thick sheet material arranged to lie over said free ends and extend lip-wise partially between said planar members.

6. The improvement as defined in claim 1, wherein said spacer means comprises silicone rubber material of 60 durometer hardness in the form of 1/16 inch thick sheet material arranged to lie over said free ends and extend lip-wise partially between said planar members, said lip extension measuring approximately ¼ inch.

7. The improvement as defined in claim 1, wherein said planar side panels are coated with acoustic insulating material on faces thereof from which said planar members extend, and fiberglass insulation extends between said planar side panels adjacent said baffle means.

* * * * *